US011666148B2

(12) United States Patent
Steere et al.

(10) Patent No.: US 11,666,148 B2
(45) Date of Patent: Jun. 6, 2023

(54) CONCEALMENT ENCLOSURE

(71) Applicant: AOB Products Company, Columbia, MO (US)

(72) Inventors: Brian Steere, Columbia, MO (US); Michael Cottrell, Ashland, MO (US); Kyle Martin, Columbia, MO (US); Curtis Smith, Columbia, MO (US); James Tayon, Moberly, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 17/189,206

(22) Filed: Mar. 1, 2021

(65) Prior Publication Data

US 2021/0267373 A1 Sep. 2, 2021

Related U.S. Application Data

(60) Provisional application No. 62/983,188, filed on Feb. 28, 2020.

(51) Int. Cl.
*A47B 96/02* (2006.01)
*A47B 81/00* (2006.01)

(52) U.S. Cl.
CPC ..... *A47B 96/021* (2013.01); *A47B 81/005* (2013.01); *A47B 96/025* (2013.01); *A47B 96/027* (2013.01)

(58) Field of Classification Search
CPC ... A47B 96/021; A47B 96/025; A47B 96/027; A47B 2220/0005; A47B 88/60; A47B 81/005
See application file for complete search history.

(56) References Cited

U.S. PATENT DOCUMENTS 3,464,606 A * 9/1969 Nordeen ..... A47B 81/005 224/281
4,309,065 A * 1/1982 Pappas ..... F41C 33/0209 224/912
4,637,303 A 1/1987 Lucky
4,848,585 A 7/1989 Snyder
5,056,342 A * 10/1991 Prinz ..... A47C 21/00 109/51
5,111,755 A * 5/1992 Rouse ..... E05G 1/00 109/47
5,329,865 A * 7/1994 McWard ..... E05G 1/04 109/50
5,996,831 A 12/1999 Teok
(Continued)

*Primary Examiner* — Stanton L Krycinski
(74) *Attorney, Agent, or Firm* — Stinson LLP

(57) ABSTRACT

A shelf assembly and components thereof, for concealing items of value of an owner from a passerby. The shelf assembly forms a concealment enclosure including a door movably connected to a shelf to permit movement of the door with respect to the shelf between an open position and a closed position. In the closed position, the door hides an interior. In the open position, access to the interior is permitted. The door includes a support surface, including a plurality of openings, arranged to be in the concealed interior when the door is closed position. A plurality of pegs are sized and shaped to be received in the plurality of openings to support the pegs extending outward from the support surface to form a customized mount for holding items of value.

11 Claims, 10 Drawing Sheets

(56) References Cited

U.S. PATENT DOCUMENTS 6,843,081 B1 * 1/2005 Painter ..... F41C 33/06 42/70.11
6,883,440 B1 * 4/2005 Correia ..... E05G 1/04 70/1.5
6,890,138 B1 5/2005 Myrick
7,116,224 B2 * 10/2006 Mickler ..... F41C 33/06 340/568.1
7,183,903 B2 * 2/2007 Nicolson ..... E05B 47/026 340/426.36
7,356,891 B2 4/2008 Freeman
7,434,427 B1 * 10/2008 Miresmaili ..... F41C 33/06 42/70.11
8,113,608 B2 2/2012 Tassin et al.
8,726,704 B2 5/2014 White
8,777,339 B2 7/2014 Tassin et al.
8,851,306 B2 10/2014 Spurr et al.
9,247,811 B2 2/2016 Spencer
9,803,957 B2 10/2017 Chavira
9,833,072 B1 * 12/2017 Knake ..... A47B 96/06
9,963,927 B1 5/2018 Dudley
10,376,057 B2 * 8/2019 Knake ..... E05B 65/44
10,413,060 B2 9/2019 Chavira
10,554,033 B2 * 2/2020 Girdzis ..... H02J 7/00
2009/0284110 A1 * 11/2009 Mascari ..... E05B 65/52 292/163
2010/0212372 A1 * 8/2010 Wolfe ..... A47B 81/00 206/317
2011/0291537 A1 * 12/2011 Baker, Jr. ..... A47B 81/00 312/326
2012/0206026 A1 8/2012 Emelio
2013/0134193 A1 * 5/2013 Mothersele ..... B60R 7/00 312/319.1
2014/0132131 A1 5/2014 Thomas
2016/0223290 A1 8/2016 Jacob
2017/0030110 A1 * 2/2017 Sahjian ..... A47B 81/00
2019/0038024 A1 2/2019 Coons

* cited by examiner

SECTION A-A

CONCEALMENT ENCLOSURE

CROSS-REFERENCE TO RELATED APPLICATION

The present application claims priority to U.S. Provisional Patent Application No. 62/983,188, filed Feb. 28, 2020, which is hereby incorporated by reference in its entirety.

FIELD

The present disclosure relates generally to hiding items of value, and more particularly to a concealment enclosure.

BACKGROUND

Various types of concealment enclosures exist for use in concealing valuables and weapons from view.

SUMMARY

In one aspect, a shelf assembly is for supporting at least one object for display and concealing items of value of an owner from a passerby. The shelf assembly comprises a shelf defining a support surface configured to support the at least one object on the shelf for display. The shelf assembly comprises a door movably connected to the shelf to permit movement of the door with respect to the shelf between an open position and a closed position without disconnecting the door from the shelf. The door in the closed position conceals an interior between the door and the shelf. The door in the open position permits access to the interior. The door comprises a support surface including a plurality of receivers. The support surface is arranged to be in the interior when the door is closed. The shelf assembly includes a plurality of item supports. Each item support includes an end portion sized and shaped to be received by the plurality of receivers to support the item supports extending outward from the support surface. Ones of the item supports are receivable by respective selected ones of the receivers to arrange said ones of the item supports with respect to each other and the support surface to form a customized mount for holding the items of value such that when the door is in the closed position the items of value are hidden from the passerby and when the door is in the open position the items of value are accessible to the owner.

In another aspect, a concealment enclosure for concealing items of value of an owner from a passerby is disclosed. The concealment enclosure comprises a frame and a door. The door is connected to the frame to permit movement of the door with respect to the frame between an open position and a closed position without disconnecting the door from the frame. In the closed position, the door conceals an interior between the door and the frame from the passerby. In the closed position, the door permits access to the interior by the owner. The concealment enclosure further comprises a support surface. The support surface includes a plurality of receivers. The support surface is arranged to be in the concealed interior when the door is closed. The concealment enclosure includes a plurality of hangers. Each hanger includes an end portion sized and shaped to be received by a respective one of the receivers to support the hangers extending outward from the support surface. The hangers are receivable by respective selected receivers to arrange said hangers with respect to each other and the support surface to form a customized mount for holding the items of value, such that when the door is in the closed position the items of value are hidden from the passerby and when the door is in the open position the items of value are accessible to the owner. When the door is closed the concealment enclosure has an outer appearance disguising the concealment enclosure as not having an interior configured to store the items of value.

Other objects and features of the present invention will be in part apparent and in part pointed out herein.

DETAILED DESCRIPTION

Figure 1:
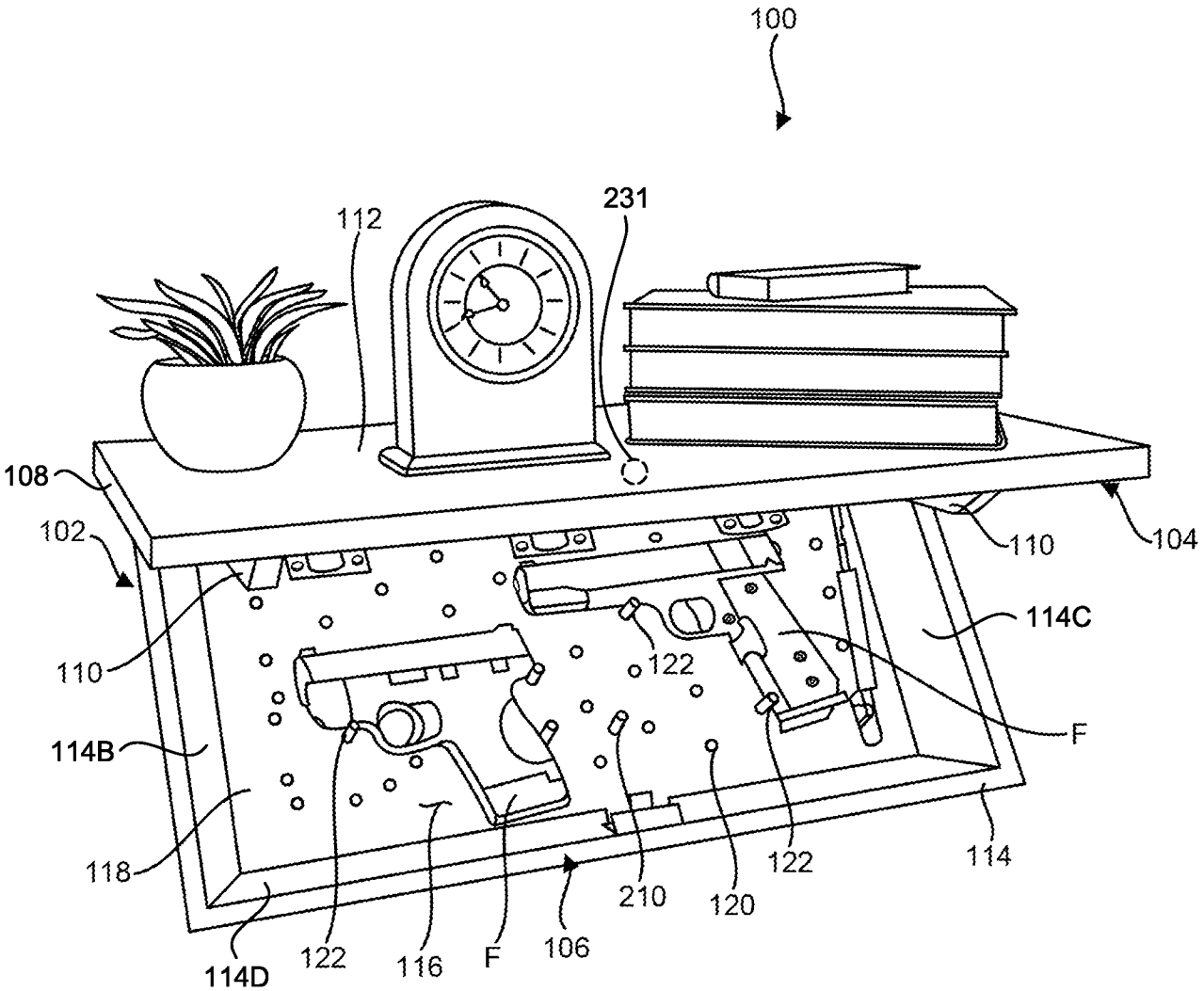
FIG. 1 is a perspective of a shelf assembly of the present application shown in an open configuration.
Figure 2:
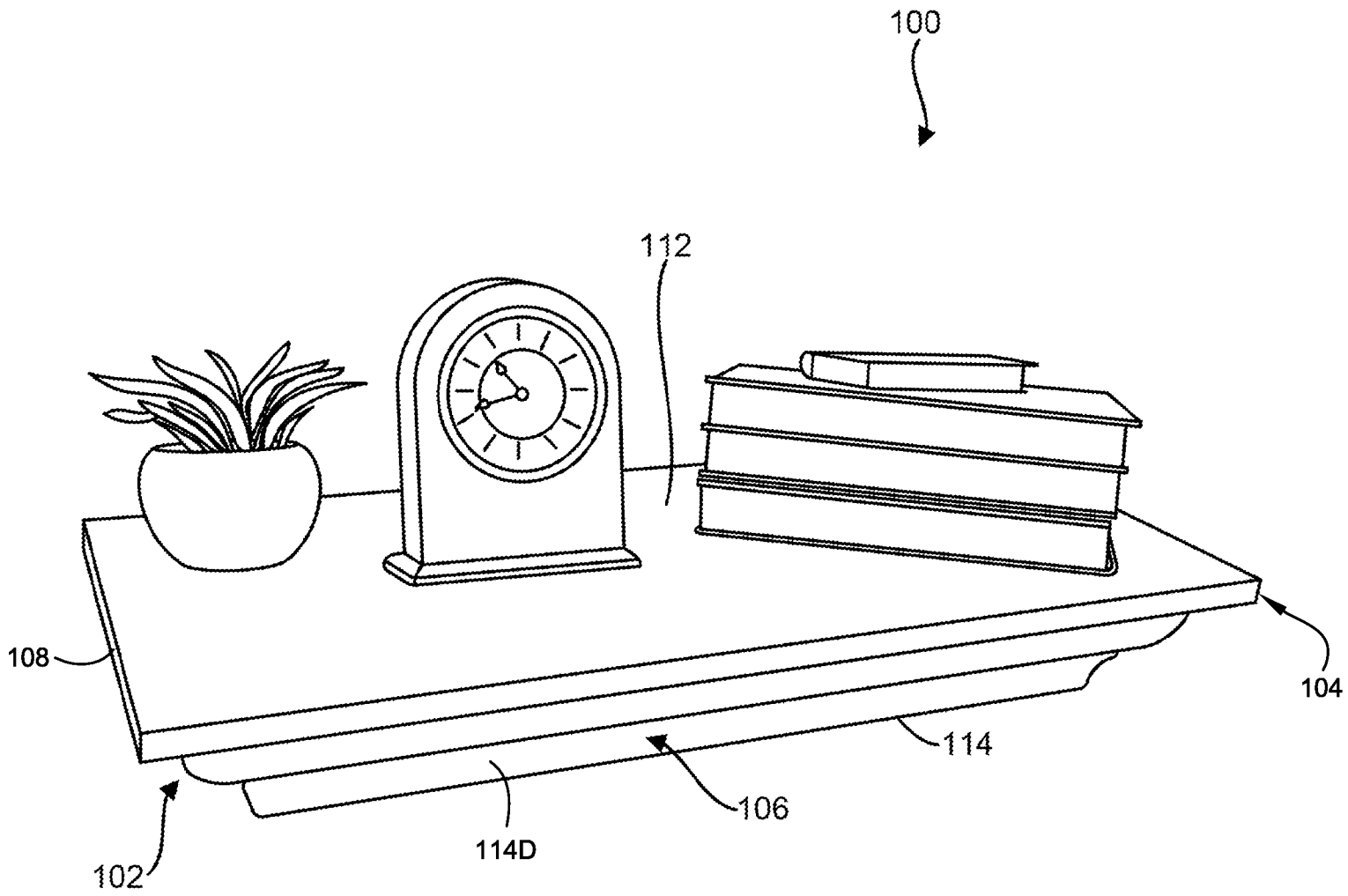
FIG. 2 is a perspective of the shelf assembly of FIG. 1 shown in a closed configuration.

Referring to FIGS. 1 and 2, an apparatus for concealing items of value is disclosed. In the disclosed embodiment, the apparatus comprises a shelf assembly 100. The shelf assembly 100 forms a concealment enclosure 102. The concealment enclosure can be used to hide valuables (e.g., wallet, keys, etc. as in FIG. 14), weapons (e.g., firearm, knife, etc. as in FIGS. 1, 13), and/or other items which a user desires to hide. The shelf assembly 100 includes a shelf 104 (broadly, "frame") and a housing 106 (broadly, "concealment enclosure"). The shelf 104 includes a shelf top 108 and frame members 110. The shelf top 108 includes a top surface 112. The shelf top 108 can be used to hold various items such as clocks, books, plants, etc. on the top surface 112.

The housing 106 forms a door 114 movably connected to the shelf 104 to permit movement of the door with respect to the shelf between an open position (FIG. 1) and a closed (concealing) position (FIG. 2) (to change the shelf assembly between open and closed configurations) without disconnecting the door from the shelf. In the closed position, the door 114 conceals an interior 116 between the door and the shelf 104. Moreover, in the closed position, the shelf assembly 100 has an appearance of merely a shelf assembly, not appearing to have an interior configured to store items inside the shelf assembly. In the open position, the door 114 permits access to the interior 116. For example, the shelf assembly 100 can be mounted to a wall using suitable fasteners 117. In the illustrated embodiment, the door 114 is connected to the shelf 104 by hinges 119 that permit the door to pivot downward and upward between the closed and open positions. Other configurations can be used without departing from the present disclosure.

Figure 3:
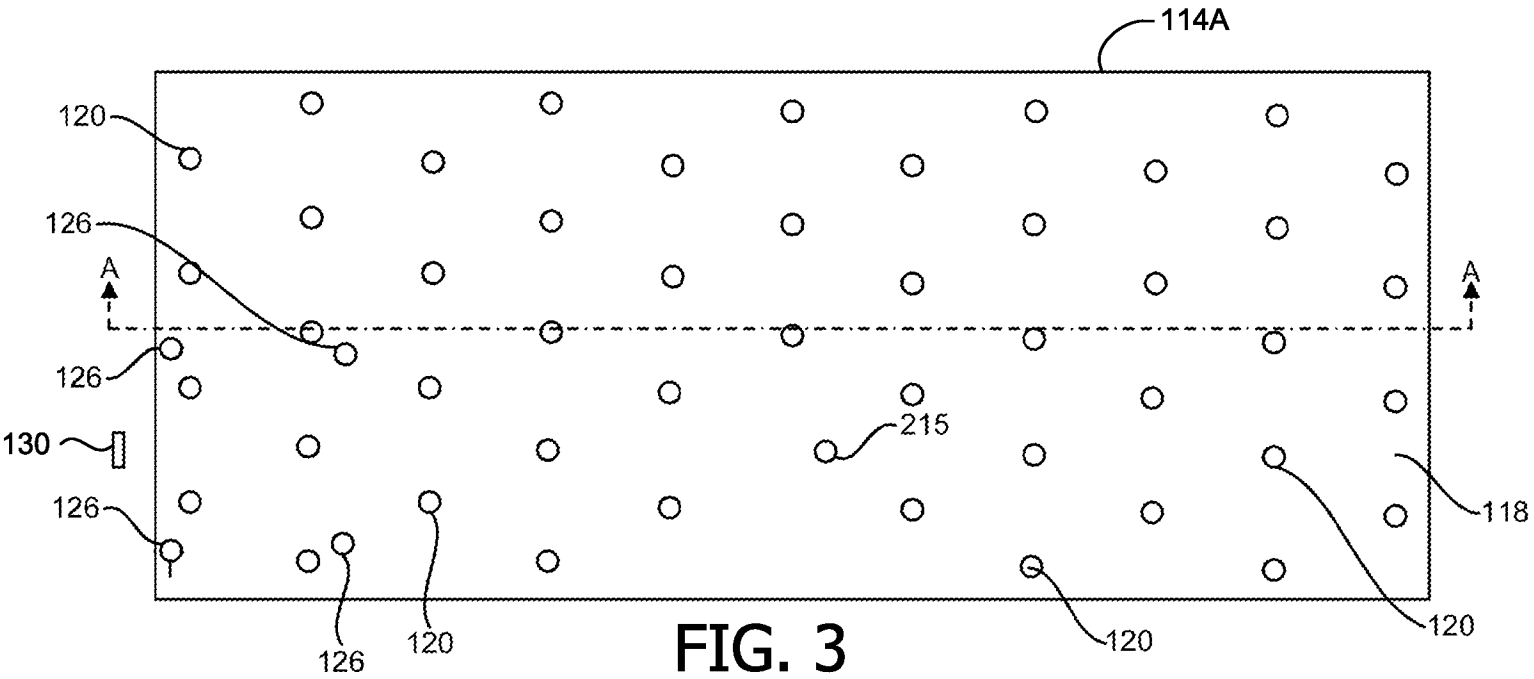
FIG. 3 is a top plan view of a bed of the shelf assembly.
Figure 4:
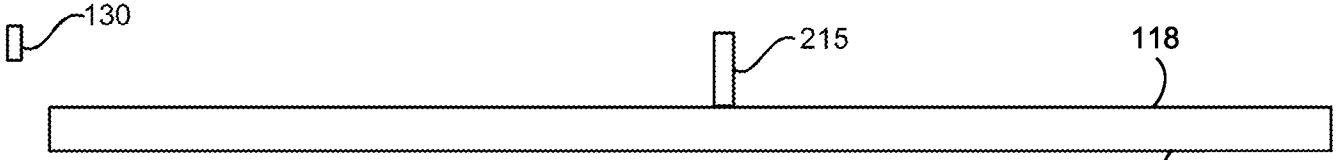
FIG. 4 is a front elevation of the bed.
Figure 5:
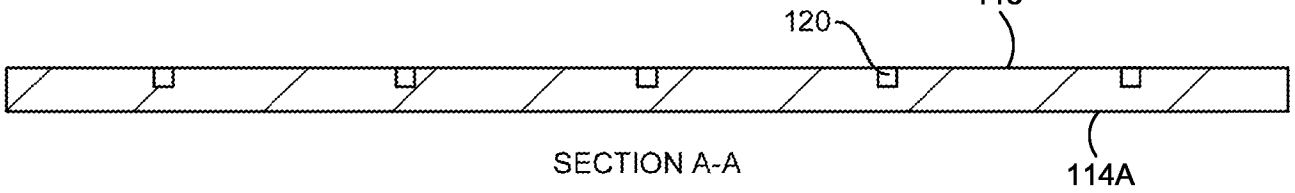
FIG. 5 is a section of the bed taken in a plane including line A-A of FIG. 3.

The door 114 comprises a bed 114A, left and right side walls 114B, 114C, and a front wall 114D. In the closed position, upper ends of the walls 114B-114D are adjacent to or abut the bottom of the shelf top 108 and appear to passersby to be decorative molding extending downward from the shelf top. The bed 114A defines a support surface 118 for supporting items stored in the shelf assembly. The support surface 118 includes a plurality of openings 120. The support surface 118 is arranged to be in the concealed interior 116 when the door is closed. The plurality of openings 120 are spaced from each other and arranged in an array. In one example, as in FIG. 3, the array can be a regular array in which the openings 120 are arranged in a repeating pattern. Other types of regular arrays can be used, and, in other embodiments, the openings can be arranged in an irregular array, such as an array having no pattern or having a non-uniform pattern.

Figure 13:
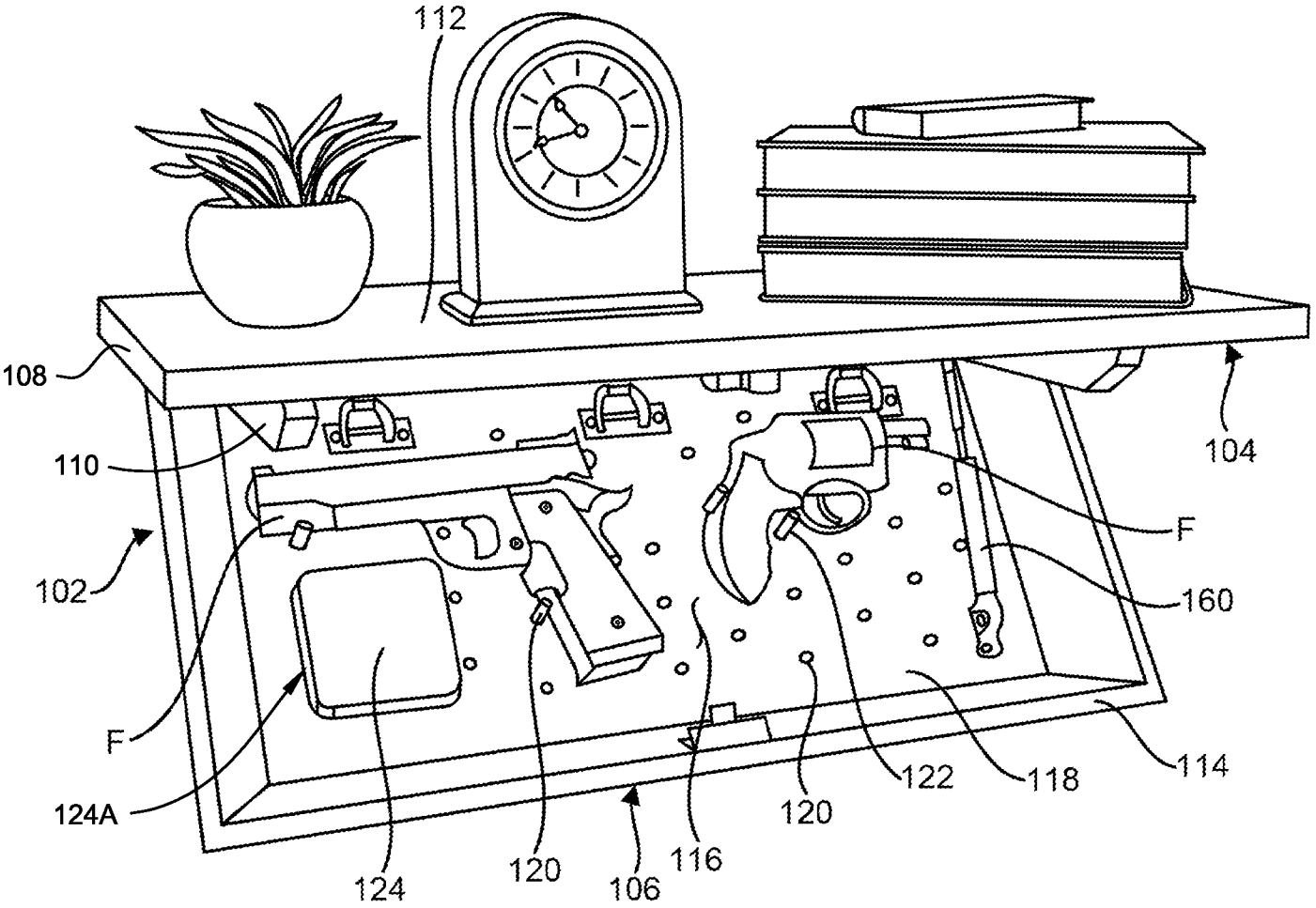
FIG. 13 is a perspective of the shelf assembly in the open configuration with the concealment enclosure sensor.
Figure 14:
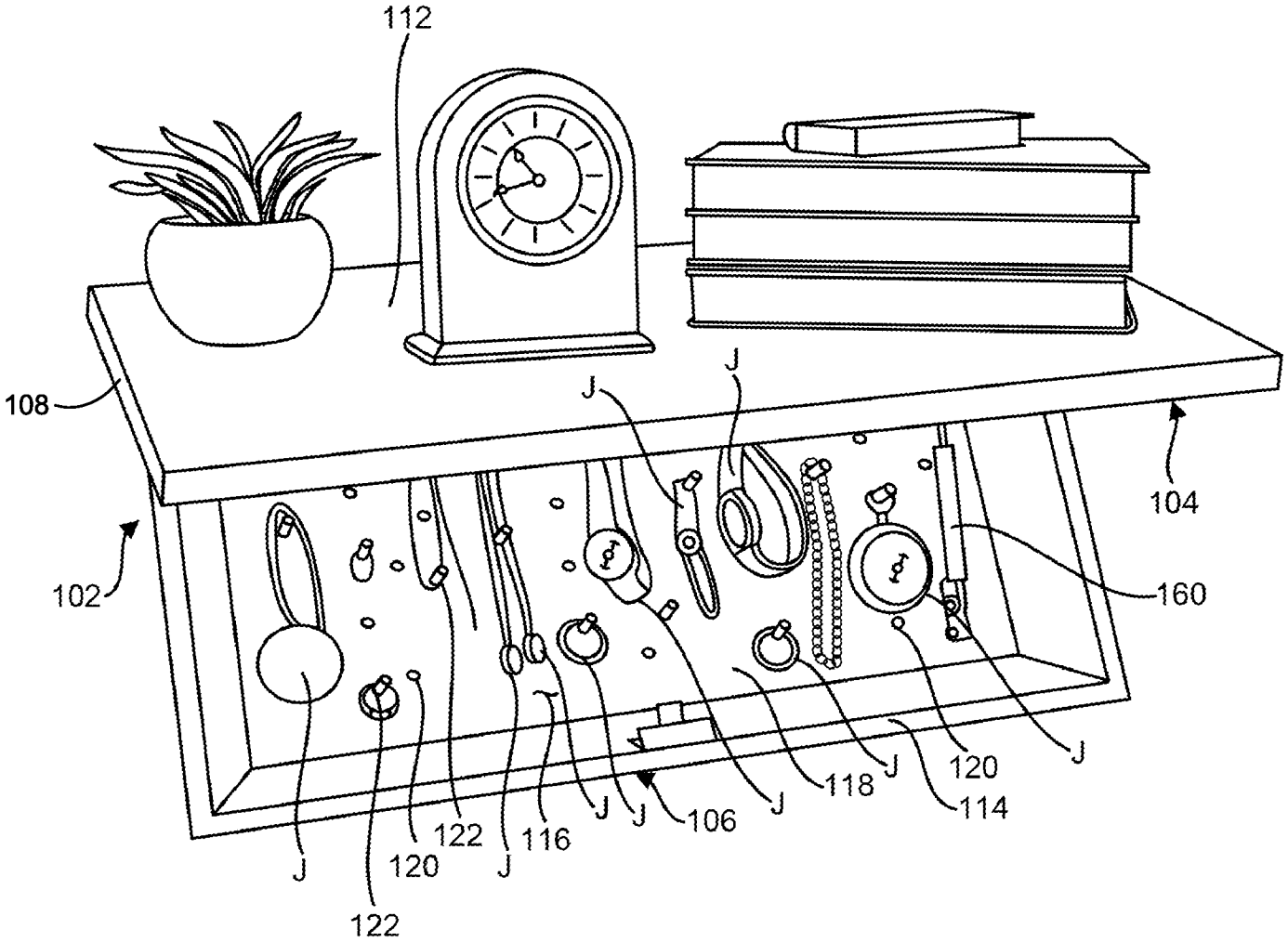
FIG. 14 is another perspective of the shelf assembly in the open configuration with an alternative arrangement of items stored therein.

The shelf assembly 100 includes a plurality of pegs 122 (broadly, "item supports"). Each peg includes an end portion sized and shaped to be received in one of the plurality of openings 120 (broadly, "receivers") to support the pegs extending outward from the support surface 118. Ones of the pegs 122 are receivable in respective selected ones of the openings 120 to arrange the pegs with respect to each other and with respect to the support surface 118 to form a customized mount for holding items of value in the enclosure interior 116, such that when the door 114 is in the closed position the items of value are hidden from passersby, and when the door is in the open position the items of value are accessible to the owner. The openings 120 are arranged for the pegs 122 to extend upward from the support surface 118 when the door 114 is in the closed position and for the pegs to extend upward and forward from the support surface when the door 114 is pivoted downward to the open position. When the door 114 is in the open position, the pegs 122 serve as hangers to limit downward sliding of the items on the support surface 118. Accordingly, the pegs 122 support the items to maintain the items in selected positions on the support surface. As is clear from comparison of the arrangements of pegs 122 in FIGS. 1, 13, and 14, the pegs can be located in selected ones of the openings 120 to define an arrangement suitable for supporting and organizing a variety of items in the shelf assembly. For example, as seen in FIGS. 1 and 13, the pegs 122 can be arranged to contact undersides of forward and rearward portions of firearms to hold them in upright orientations when the door 114 is opened. The pegs 122 can be removed from the openings 120 and re-arranged per user desires, to re-customize the storage arrangement when additional or different items are to be stored.

Other types of item supports can be used without departing from the scope of the present disclosure. For example, instead of or in addition to pegs 122, the item supports can include hooks, pins, brackets, rods, etc. Each item support has at least one portion receivable in an opening 120 and another portion located to engage an item to be supported by the item support. In some embodiments, depending on the configuration of the concealment enclosure, the item supports may extend generally horizontally from the support surface, in which case the items stored on the item supports may primarily rest on them as hangers and rest minimally or not at all on the support surface. Other variations of item supports can be used without departing from the scope of the present disclosure.

Figure 11:
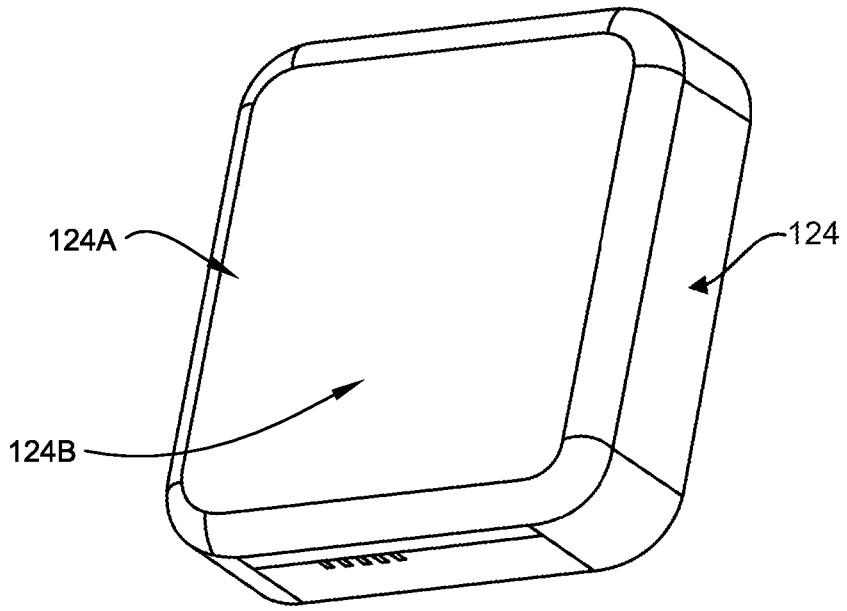
FIG. 11 is a front perspective of a concealment enclosure sensor usable with the concealment enclosure.
Figure 12:
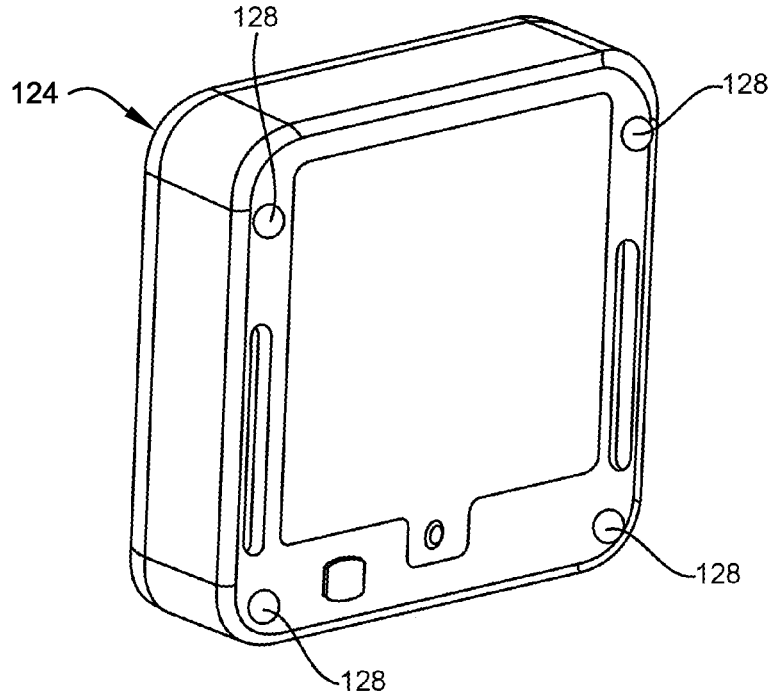
FIG. 12 is a rear perspective of the concealment enclosure sensor.

Referring to FIGS. 3, 11, 12, and 13, the concealment enclosure 102 is usable with a concealment enclosure sensor 124. The concealment enclosure sensor 124 (broadly, "monitor") can be used to monitor aspects of the concealment enclosure 102, such as open/closed, temperature, humidity, jarring/motion, programming, alerts, alarms, etc. The concealment enclosure sensor 124 can be part of a larger security system and/or provide the user with updates, alerts, and/or alarms regarding status of the concealment enclosure 102. A monitor usable as the concealment enclosure sensor 124 is disclosed in more detail in co-assigned U.S. patent application Ser. No. 17/104,462, filed Nov. 25, 2020, which is hereby incorporated by reference in its entirety. The concealment enclosure sensor 124 can have the same structure, programming, and function as the monitor disclosed therein. For example, the concealment enclosure sensor 124 can include one or more sensors, such as a temperature sensor, humidity sensor, a position sensor 124A, and/or a motion sensor 124B. In one example, the position sensor 124A (e.g., Hall effect sensor) is configured to sense a location of the sensor with respect to a magnet or reference 130. The position sensor 124A enables the 124 to sense whether the door 114 is open or closed (broadly, "position security event"). The motion sensor 124B could be an accelerometer or other type of sensor configured to sense motion to detect jarring, shaking, or other movement of the shelf assembly. In FIG. 11, the sensors 124A, 124B are indicated generally and are understood to be inside a housing of the monitor 124.

The shelf assembly is preconfigured to mount the concealment enclosure sensor 124 thereon, such as shown in FIG. 13. In the illustrated embodiment, the door 116 includes a plurality of connectors 126 configured to connect to the concealment enclosure sensor 124 to mount the concealment enclosure sensor to the door. For example, four connectors 126 are provided on the door 114. The concealment enclosure sensor 124 includes corresponding connectors 128 configured to form connections with the connectors 126. In the illustrated embodiment, the connectors 126 comprise steel pins (broadly, "ferromagnetic connectors") received in recesses in the door 114, and the connectors 128 comprise magnets. The connectors 126 are spaced and arranged to correspond to the spacing and arrangement of the connectors 128 so the magnetic connections are formed simply by applying the sensor 124 on the door 114 in the appropriate location on the door. The magnetic connections hold the sensor 124 in position on the door 114 until the user applies sufficient force to the sensor to pull it away from the shelf assembly (e.g., to change batteries).

It will be appreciated that the location of the connectors 126 and 128 could be swapped such that one or more of the magnets are on the door 114 and one or more of the ferromagnetic connectors is on the sensor 124. Other types of connectors can be used. Moreover, the connectors could be arranged for mounting the sensor 124 in other locations on the shelf assembly.

The shelf assembly 100 includes a magnet 130 (broadly, "sensor reference") preconfigured to interact with the concealment enclosure sensor when it is mounted in the preset location on the shelf assembly. In particular, the magnet 130 is located with respect to the connectors 126 to be arranged to be sensed by the position sensor 124A (broadly, "magnet sensor") of the concealment enclosure sensor 124 when the concealment enclosure sensor is mounted on the shelf assembly by connection of the first and second connectors 126, 128. In the embodiment illustrated in FIG. 13, the magnet 130 is recessed into a side of the shelf 104, and in particular on an inside of the left frame member 110. The position sensor 124A detects the magnet 130 to determine whether the door 114 is in the open or closed position. When the concealment enclosure sensor 124 is mounted in the preset location on the door 114 and the door is closed, the position sensor 124A is located in registration with the magnet. The position sensor 124A can sense the presence or absence of the magnet 130 to determine if the door is in the open or the closed position. When the door 114 is in the closed position, the position sensor 124A is proximate to the magnet 130 and detects its presence, thereby indicating that the door is in the closed position. When the door 114 is in the open position, the position sensor 124A is spaced apart from (below) the magnet 130 and the concealment enclosure sensor 124 cannot detect the presence of the magnet, thereby indicating that the door is in the open position.

In view of the disclosure in U.S. patent application Ser. No. 17/104,462, incorporated by reference above, it will be appreciated that the owner or user of the shelf assembly can receive notifications, alerts, and/or alarms responsive to the concealment enclosure sensor 124 detecting the door being open or closed via the position sensor 124A and/or detecting movement via the motion sensor 124B.

Figure 6:
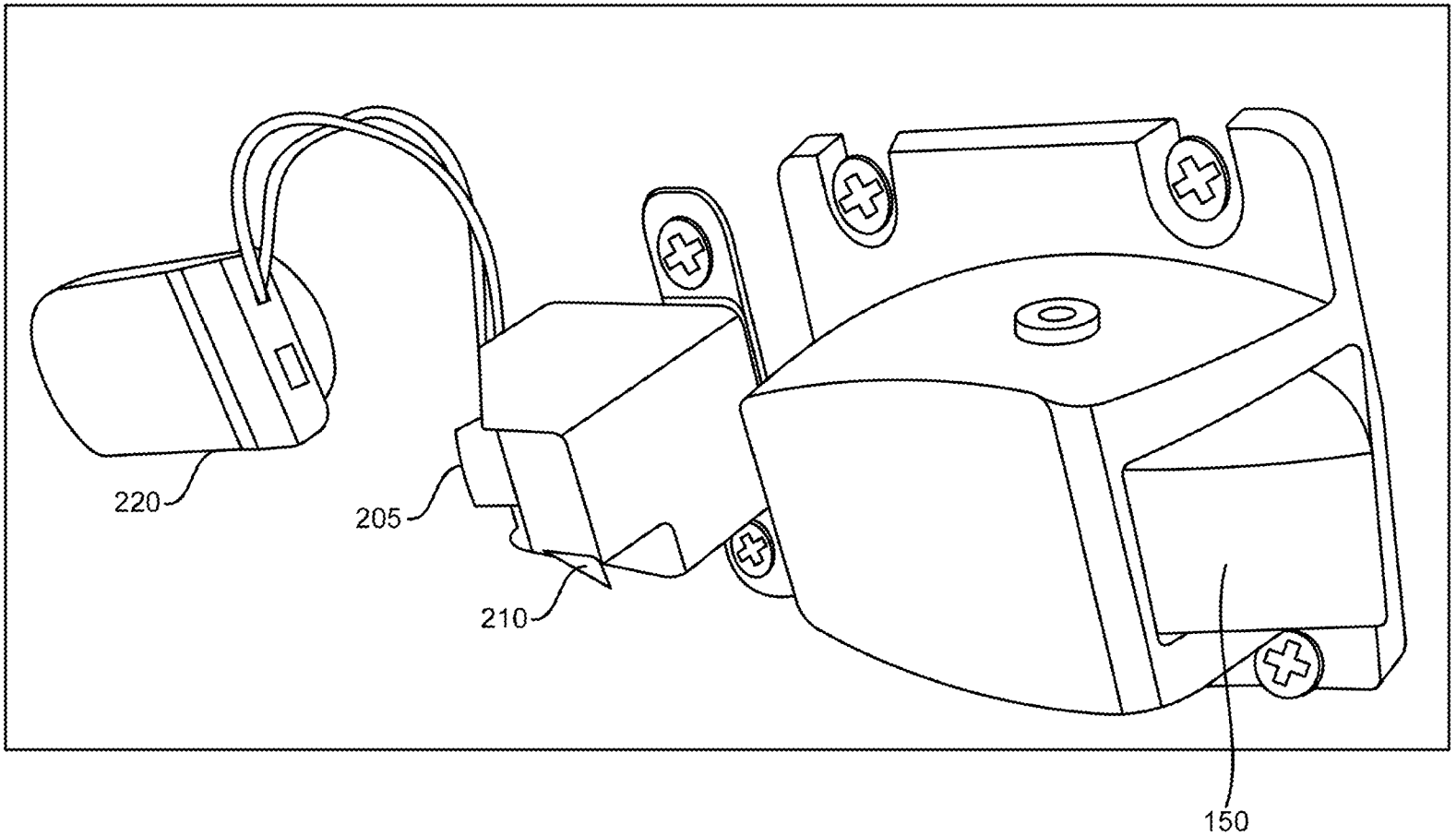
FIG. 6 is a perspective of an illumination system and retainer of the shelf assembly.
Figure 7:
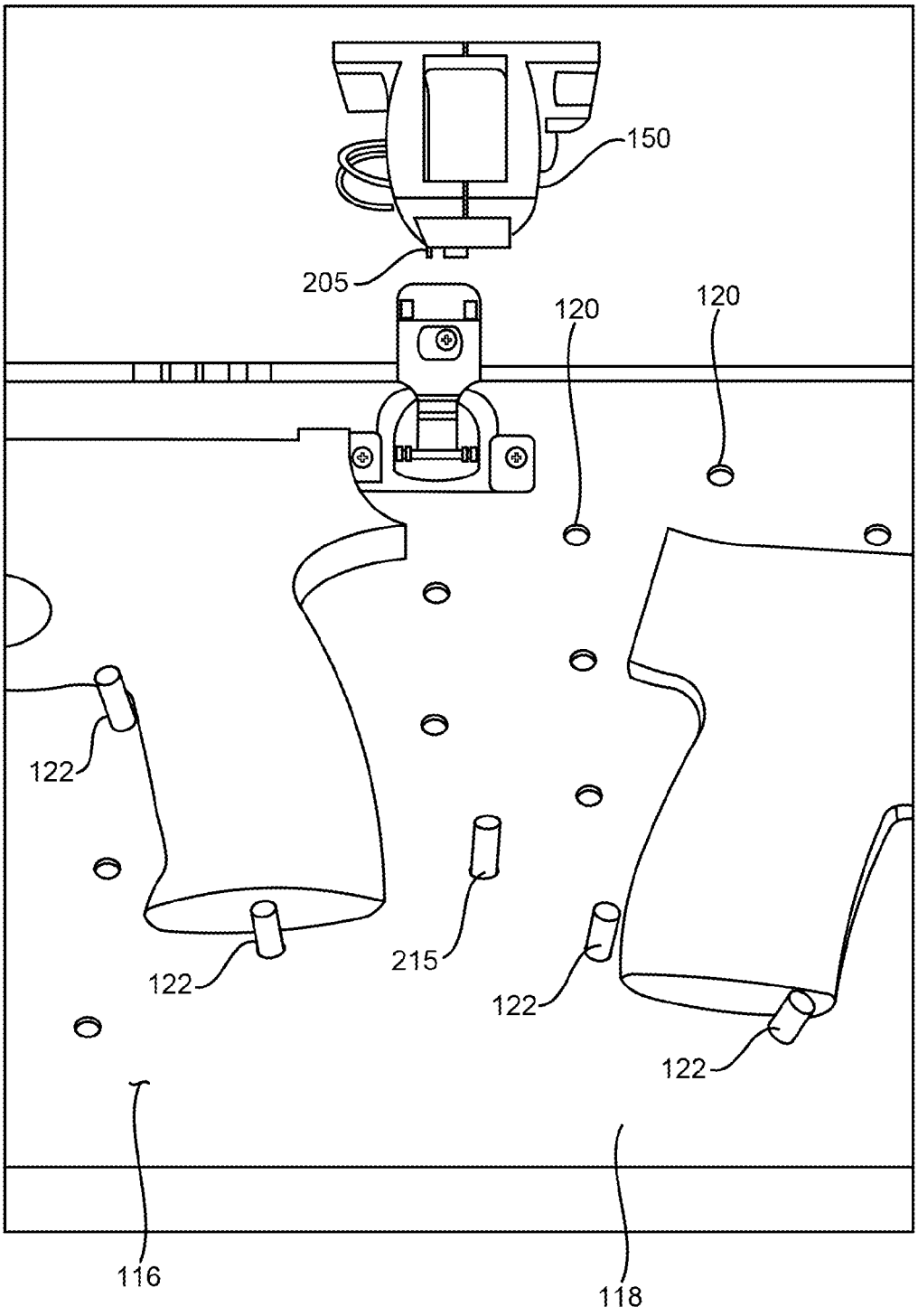
FIG. 7 is a perspective of the illumination system illuminating the support surface of the shelf assembly, when the shelf assembly is in the open configuration.
Figure 8:
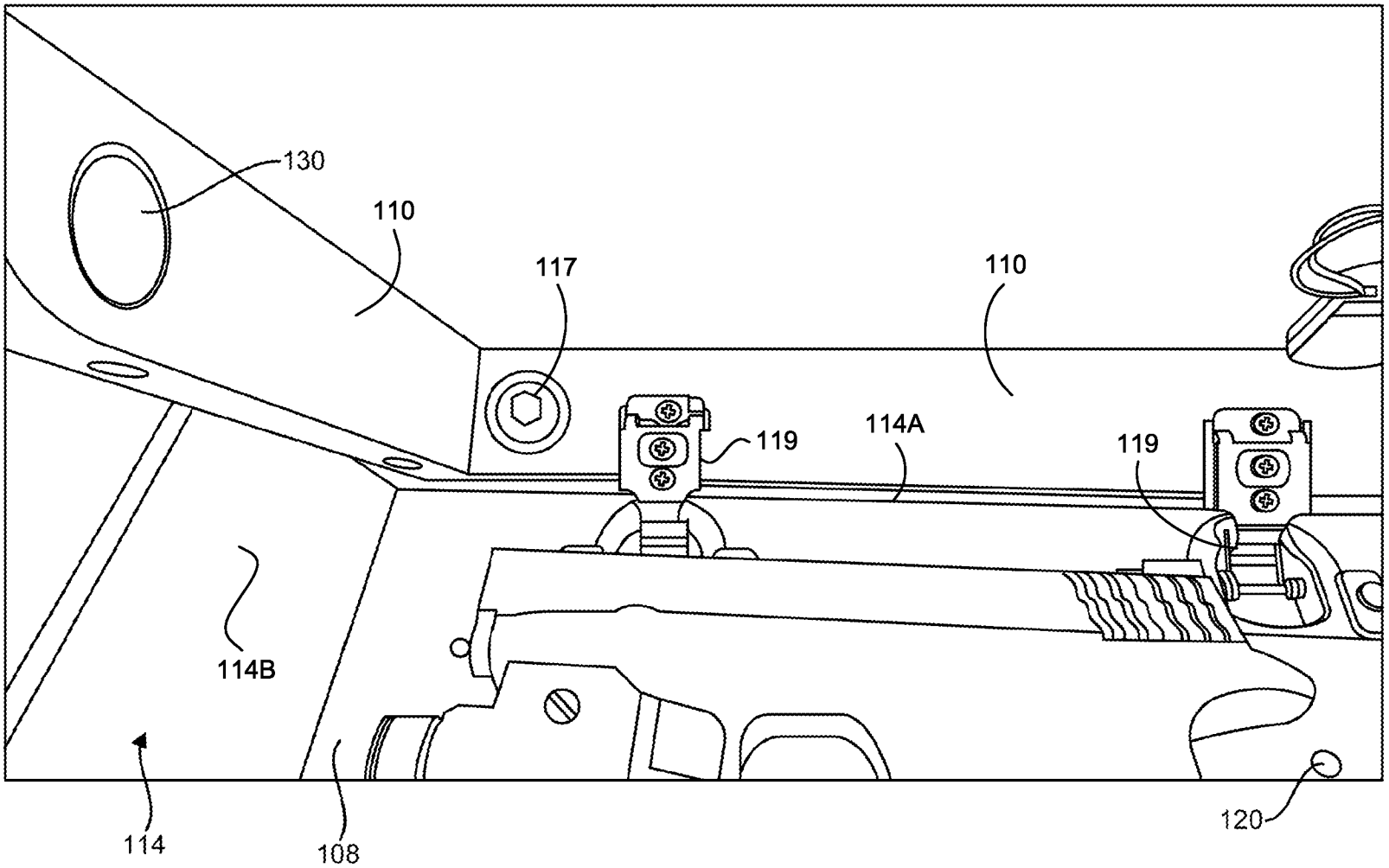
FIG. 8 is a fragmentary bottom perspective of the shelf assembly shown in the open configuration.

Referring to FIGS. 6 and 7, the shelf assembly 100 includes an illumination system 200. The illumination system 200 includes an LED 205, an LED activator 210, an LED actuator 215, and a battery holder 220. Several of these components are mounted to the underside of the shelf top 108, as shown in FIGS. 6 and 7. The LED actuator 215 is arranged to engage the LED activator 210 when the door 114 is in the closed position to cause the LED 205 to not emit light. When the shelf assembly 100 is in the open position, the LED actuator 215 is arranged to not engage the LED activator 210 to cause the LED 205 to emit light. The LED 205 is powered by at least one battery in the holder 220. The battery holder 220 is desirably movable with respect to the LED 205 (e.g., tethered via flexible power cord) and removably mounted (e.g., attached by hook and loop fasteners to the underside of the shelf top 108) to allow a user to remove and replace the battery more easily.

Figure 9:
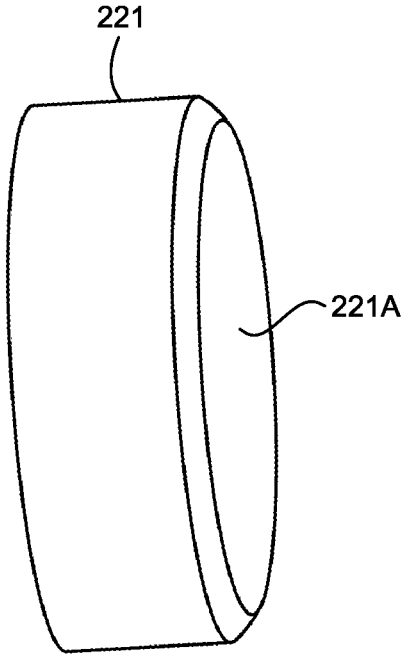
FIG. 9 is a perspective of a magnet key usable with the shelf assembly.
Figure 10:
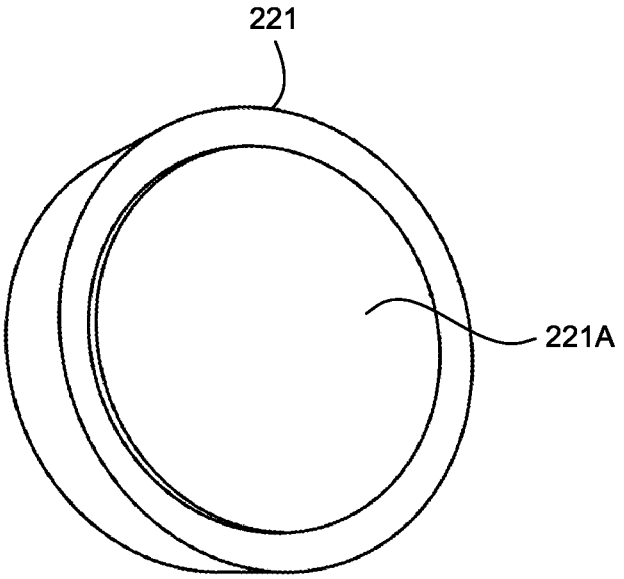
FIG. 10 is a rear perspective of the magnet key.

Referring to FIGS. 6 and 7, the shelf assembly 100 includes a retainer 150 arranged to releasably retain the door 114 in the closed position. The shelf assembly 100 comprises a magnetic key 221 (FIGS. 9 and 10) including a magnet 221A configured to be located with respect to the retainer 150 to release the retainer to permit the door 114 to move from the closed position to the open position. In the illustrated embodiment, the retainer 150 comprises a latch, and the key 221 is configured to release the latch. The retainer 150 engages the door 114 (e.g., a keeper on the inside of the front wall 114D) to hold and secure the door in the closed position and disengages the door to permit the door to move downward to the open position.

In the illustrated embodiment, the retainer 150 comprises a ferromagnetic release (hidden from view in the retainer housing). The ferromagnetic release is arranged to release the retainer by magnetic attraction of the ferromagnetic release toward the magnetic key. Alternatively, the latch of the retainer can comprise ferromagnetic material such that the magnet key attracts the latch rearward to release the door 114. When the magnetic key is disposed proximate (e.g., generally over) the retainer 150 (e.g., on top of the shelf top 108), the magnet 221A of the key 221 attracts the retainer to release the retainer and permit the door to move to the open position. The retainer 150 may be biased toward a retaining position, such that the retainer secures the door 114 in the closed position when the key is not proximate to the retainer.

The shelf top 108 can include a ferromagnetic member 231 (broadly, "aligner") placed directly above the retainer (e.g., vertically aligned with the magnet inside the retainer) inside the shelf top (hidden from view from above) to assist in the alignment of the key with the retainer to permit the door 114 to move toward the open position. The magnet in the key will be attracted to the aligner in the shelf top 108, thereby helping to position the key in the correct position on the shelf top, and relative to the retainer 150, to unlock the retainer. This allows the owner to easily unlock the shelf 104 in low light conditions or if the user has only a general idea of where to place the key. Once the key is properly positioned over the retainer 150 by its attraction to the aligner in the shelf top 108, the magnet in the key releases the retainer to open the concealment enclosure 102.

In another aspect, the shelf assembly 100 comprises a piston 160 (FIG. 13). A first end portion of the piston is connected to the door 114 and a second end portion of the piston is connected to the shelf 102. The piston is arranged to control movement of the door 114 away from the closed position toward the open position in a smooth motion to not disrupt location of items stored on the door.

It will be appreciated that features of the shelf assembly 100 described above can be used in other embodiments of concealment enclosures without departing from the scope of the present disclosure. Other embodiments of concealment enclosures can have other appearances or configurations (e.g., HVAC air vent or register, artwork, etc.), but have one or more features or combination of features described above. For example, in other embodiments, the apparatus may include a frame and a housing defining an interior for concealing items therein, and may include an adjustable or reconfigurable support system (e.g., pegs, etc.) for supporting items in the interior. Other ornamental appearances can be used to disguise the concealment enclosure from a passerby. Such concealment enclosures (when the door is closed) have outer appearances disguising the concealment enclosures as not having an interior configured to store items therein.

What is claimed is:

1. A shelf assembly for supporting at least one object for display and concealing items of value of an owner from a passerby, the shelf assembly being useable with a concealment enclosure sensor, said shelf assembly comprising:

a shelf defining a support surface configured to support the at least one object on the shelf for display;

a door movably connected to the shelf to permit movement of the door with respect to the shelf between an open position and a closed position without disconnecting the door from the shelf, the door in the closed position concealing an interior between the door and the shelf, the door in the open position permitting access to the interior, the door comprising a support surface including a plurality of receivers, the support surface being arranged to be in the interior when the door is closed;

at least one of the shelf or the door comprising a retainer including a latch, and the other of the shelf or the door including a keeper configured to engage the latch, the latch being configured to be actuated by a magnet to unlatch the latch;

a plurality of item supports, each item support including an end portion sized and shaped to be received by a selected one of the receivers to support the item supports extending outward from the support surface, wherein the item supports are arrangeable with respect to each other and the support surface to form a customized mount with the end portions of the plurality of item supports received by the receivers for holding the items of value, such that when the door is in the closed position the items of value are hidden from the passerby and when the door is in the open position the items of value are accessible to the owner;

wherein at least one of the shelf or the door includes a first shelf assembly connector configured to connect to the concealment enclosure sensor to mount the concealment enclosure sensor, the first shelf assembly connector being different than the latch.

2. A shelf assembly as set forth in claim 1, wherein the door is pivotable downward away from the shelf and the receivers are arranged for the item supports to extend upward from the support surface when the door is in the closed position and the item supports are received by the receivers.

3. A shelf assembly as set forth in claim 1, in combination with the concealment enclosure sensor, the concealment enclosure sensor including a motion sensor or a position sensor.

4. A shelf assembly as set forth in claim 3, wherein the first shelf assembly connector comprises ferromagnetic material and the concealment enclosure sensor includes a second connector comprising a magnet arranged to connect to the ferromagnetic material.

5. A shelf assembly as set forth in claim 1, wherein the first shelf assembly connector comprises a plurality of first shelf assembly connectors configured to connect to the concealment enclosure sensor at the same time.

6. A shelf assembly as set forth in claim 1, in combination with the concealment enclosure sensor, the concealment enclosure sensor including a magnet sensor and including a first concealment enclosure sensor connector, the first concealment enclosure sensor connector being arranged to form a connection with the first shelf assembly connector to mount the concealment enclosure sensor on the shelf assembly, wherein the shelf assembly includes a magnet located with respect to the first shelf assembly connector to be sensed by the magnet sensor when the concealment enclosure sensor is mounted on the shelf assembly by connection of the first shelf assembly connector and the first concealment enclosure sensor connector.

7. A shelf assembly as set forth in claim 1, including an illumination system, the illumination system including:

a light emitting diode (LED);

an LED activator; and an LED actuator arranged to, when the door is in the closed position, engage the LED activator to cause the LED to not emit light.

8. A shelf assembly as set forth in claim 7, wherein the LED actuator is arranged to, when the door is in the open position, not engage the LED activator to cause the LED to emit light.

9. A shelf assembly as set forth in claim 1, in combination with the magnet, the magnet being configured to be located with respect to the retainer to release the latch from the keeper to permit the door to move from the closed position to the open position.

10. A shelf assembly as set forth in claim 9, further comprising a ferromagnetic aligner arranged to attract the magnetic key toward a release position to release the latch.

11. A shelf assembly as set forth in claim 1, further comprising a piston, wherein a first end portion of the piston is connected to the door and a second end portion of the piston is connected to the shelf, the piston being arranged to control movement of the door away from the closed position toward the open position.

* * * * *